US006572353B2

(12) United States Patent
Hansen

(10) Patent No.: US 6,572,353 B2
(45) Date of Patent: Jun. 3, 2003

(54) HYDRAULIC GEROTOR MOTOR HAVING A VALVE PLATE ADJACENT THE TOOTHED WHEEL

(75) Inventor: Gunnar L. Hansen, Nordborg (DK)

(73) Assignee: Sauer-Danfoss Holding A/S, Nordborg (DK)

( * ) Notice: Subject to any disclaimer, the term of this patent is extended or adjusted under 35 U.S.C. 154(b) by 0 days.

(21) Appl. No.: 09/994,005

(22) Filed: Nov. 16, 2001

(65) Prior Publication Data

US 2002/0081225 A1 Jun. 27, 2002

(30) Foreign Application Priority Data

Nov. 17, 2000 (DE) ..... 100 56 973

(51) Int. Cl.[7] ..... F03C 2/08
(52) U.S. Cl. ..... 418/61.3
(58) Field of Search ..... 418/61.3

(56) References Cited

U.S. PATENT DOCUMENTS

| | | | | | |
|---|---|---|---|---|---|
| 3,270,681 | A | * | 9/1966 | Charlson | 418/61.3 |
| 3,289,601 | A | * | 12/1966 | Compton | 418/61.3 |
| 4,187,062 | A | * | 2/1980 | Traut | 418/61.3 |
| 4,316,707 | A | * | 2/1982 | Hansen et al. | 418/61.3 |
| 4,741,681 | A | * | 5/1988 | Bernstrom | 418/61.3 |

* cited by examiner

*Primary Examiner*—John J. Vrablik

(57) ABSTRACT

A hydraulic motor has a housing with an inner toothed ring, and an outer toothed wheel eccentrically mounted within the ring, with pressure pocket space between the teeth of the ring and the wheel. The wheel is eccentrically rotatably and orbitally mounted within the ring. A rotary slide valve is mounted within the wheel. A valve plate with an open center is adjacent the wheel. A rotary slide valve is positioned within the open center of the valve plate. Fluid under pressure in passageways is provided to a front group of pressure pocket spaces to cause the wheel to rotate. An output shaft is operatively connected to the wheel.

9 Claims, 5 Drawing Sheets

HYDRAULIC GEROTOR MOTOR HAVING A VALVE PLATE ADJACENT THE TOOTHED WHEEL

BACKGROUND OF THE INVENTION

The invention relates to an improvement in a hydraulic motor, having an inner-toothed toothed ring, an outer-toothed toothed wheel that rotates inside the toothed ring at a rotational speed and orbits therein at an orbital speed, a shaft, which is connected non-rotatably to the toothed wheel, with a suitable hydraulic fluid valve. Such a machine is known from U.S. Pat. No. 3,288,034.

Such a machine operates according to the gerotor principle. The toothed wheel generally has one tooth less than the toothed ring and is mounted eccentrically in the toothed ring. The geometries of the toothed wheel and toothed ring are so matched with one another that a number of pressure pockets are formed between the toothed wheel and the toothed ring. That number corresponds to the number of teeth of the toothed wheel. The individual pressure pockets are sealed of from one another by the points of contact between the toothed wheel and the toothed ring. On rotation of the toothed wheel, the toothed wheel orbits relative to the toothed ring by a number of revolutions that corresponds to the number of teeth of the toothed wheel. In the process, the pressure pockets in one half of the toothed gearing formed by the toothed ring and toothed wheel increase in size, whilst the pressure pockets in the other half of the toothed gearing decrease in size. The dividing line or plane between those two halves revolves at the orbital speed of the toothed wheel. In the case of the pressure pockets that are decreasing in size, care must be taken to ensure that the displaced fluid can escape. In the case of the pressure pockets that are increasing in size, care must accordingly be taken to ensure that fluid can be fed in. In a motor, fluid is supplied, under pressure, to the pressure pockets that are increasing in size, whilst in a pump the fluid from the pressure pockets that are decreasing in size is brought to a higher pressure. The valve arrangement is required to ensure correct supply to the individual pressure pockets. The valve arrangement must ensure that the connection between supply connections and the pressure pockets is always made at the right moment. This control of the hydraulic fluid, also called "commutating", generally requires a valve arrangement of relatively complicated construction, which results in an increase in the volume and weight of the machine.

It is therefore an object of this invention to enable simplified construction of the valve arrangement in such a motor.

SUMMARY OF THE INVENTION

The instant invention has a valve arrangement including a rotary slide valve, which rests against an end face of a toothed wheel and rotates relative to the toothed ring at the orbital speed.

In that construction it is possible to provide the valve arrangement in the direct vicinity of the toothed gearing. This avoids the need for a separate "cover" for the toothed gearing. It also makes it possible to avoid having two seals, namely on the one hand between the toothed gearing and the mentioned cover and on the other hand between the rotary slide valve and the cover on the opposite side. Although the rotary slide valve thus rests directly against the toothed wheel, it moves relative to the rotating toothed wheel at a speed determined by the ratio of the rotational speed to the orbital speed of the toothed wheel. The rotary slide valve also effects a corresponding movement relative to the toothed ring. This is not critical, however, because the rotary slide valve, owing to its relatively high rotational speed, can always ensure that its side to which fluid is supplied is connected to the pressure pockets that are increasing in size, whilst its other side, which is connected to a connection for escaping fluid, is connected to the pressure pockets that are decreasing in size. Accordingly, any leakages at the contact face between the rotary slide valve and the toothed wheel or the toothed ring are relatively uncritical. What is important, however, is that no short circuit occurs through the rotary slide valve or over it. As a result of the fact that the rotary slide valve is arranged directly at the toothed gearing, it is also possible to save a certain amount of constructional space, which additionally results in weight being saved, because fewer parts are required. The number of moving parts is kept extraordinarily low. In the valve arrangement, in principle only the rotary slide valve is moved. The orbital speed is the speed at which the centre points of the toothed wheel and toothed ring rotate relative to one another.

The rotary slide valve and the toothed wheel are preferably connected to one another directly by way of a drive connection. The direct connection of the toothed wheel and rotary slide valve reduces commutation faults, which could be caused by play. The commutation can accordingly be effected more precisely, so that noise is avoided and efficiency losses remain low.

Preferably the drive connection is formed by a pin that engages the toothed wheel centrally and the rotary slide valve eccentrically, which pin is mounted to rotate relative to at least one of the two parts, the rotary slide valve being mounted centrally in a valve housing. The pin that engages the rotary slide valve eccentrically thus forms a crank mechanism that converts the orbital movement of the toothed wheel into a rotational movement of the rotary slide valve. That crank mechanism is especially advantageous in a situation in which the rotary slide valve rests against the toothed wheel, because in that case there are no exposed lengths on which the pin could become bent. Very precise control of the rotary slide valve is thus obtained by the toothed wheel.

It is especially preferred for the pin to be formed integrally with one of the two parts, toothed wheel and rotary slide valve. "Integrally" should here be understood as meaning that the pin is secured firmly, that is to say without play, in the associated part. This can be achieved firstly by the pin actually forming a unit with the associated part. That integrality can also be obtained, however, by securing the pin to the part by a different method, for example by forcing into position, shrink-fitting, welding or similar methods. The possibility of play is then restricted to a single point of connection, namely at the point at which the pin cooperates with the other of the two parts.

It is especially preferred for the pin to be mounted rotatably in a bore, the inner diameter of which corresponds to the outer diameter of the pin. The diameter of the bore and pin can be matched with one another relatively precisely. The risk of play occurring is thus further reduced.

The rotary slide valve preferably divides the interior of the valve housing into a high-pressure side and a low-pressure side. As already explained above, this has the advantage that the dividing line between the high-pressure side and the low-pressure side rotates at the speed of the rotary slide valve. This corresponds to the orbital speed of the toothed wheel relative to the toothed ring. The individual pressure pockets between the toothed wheel and toothed ring are thus automatically exposed to the correct pressure distribution at their supply side.

Preferably pressure pockets formed between the toothed wheel and the toothed ring are open towards the interior. No additional channels are therefore required to supply the fluid to, or take it away from, the pressure pockets. This avoids pressure losses so that the efficiency of the machine can be improved further.

Preferably, in each case a sealing strip is arranged at the rotary slide valve between the high-pressure side and the low-pressure side, which sealing strip rests radially inwards against the valve housing. That sealing strip ensures that the rotary slide valve and the valve housing can also be formed with a small amount of play between them, that is to say the friction losses between the valve housing and the rotary slide valve are reduced because contact is restricted to the region of the sealing strip, which region is relatively small in the circumferential direction. The sealing strip, for its part, ensures sufficient separation between the high-pressure side and the low-pressure side, that sealing zone rotating with the rotary slide valve relative to the valve housing.

It is preferred for the sealing strip to be mounted with play relative to the rotary slide valve. That construction has the advantage that hydraulic fluid from the high-pressure side can pass underneath the sealing strip and thus provides contact pressure of the sealing strip against the inner circumference of the valve housing. The greater the pressure difference between the high-pressure side and the low-pressure side, the greater is the sealing requirement. That requirement is automatically fulfilled by the fact that the sealing strip in such a case is pressed against the inner circumference of the valve housing with increased pressure.

The rotary slide valve preferably has a first supply channel, which opens on one side of the rotary slide valve and passes through a bearing pin, and a second supply channel, which opens, on the one hand, on the other side of the rotary slide valve and, on the other hand, into an annular chamber surrounding the bearing pin. The rotary slide valve is thus additionally used to distribute the hydraulic fluid from a supply arrangement to the high-pressure side and the low-pressure side.

It is especially preferred for the bearing pin to be mounted rotatably in an end-face cover.

In an alternative construction, the rotary slide valve can have on its end face remote from the toothed wheel a high-pressure "kidney" shaped recess and a low-pressure "kidney" shaped recess, which, upon rotation, come into registration with openings of channels, the channels passing around the outside of the rotary slide valve to the end face of the toothed wheel. In that construction, the rotary slide valve itself can be of smaller construction, which is advantageous especially in the case of rapidly rotating machines, because the moment of inertia of the rotary slide valve is then smaller. That construction is not generally associated with an increase in constructional length because the channels can be formed in an end-face cover that is necessary anyway.

DESCRIPTION OF THE EMBODIMENTS OF THE INVENTION

Figure 1:
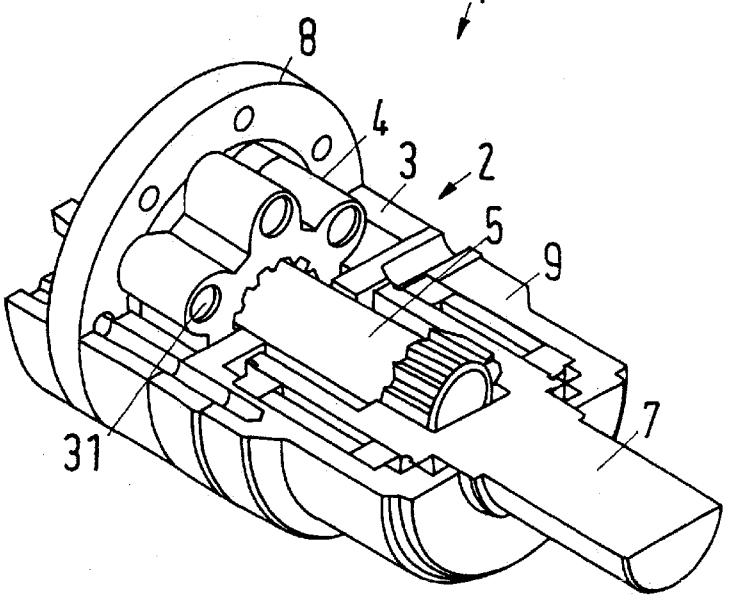
FIG. 1 is a perspective view, in partial section, of the hydraulic motor of this invention.
Figure 2:
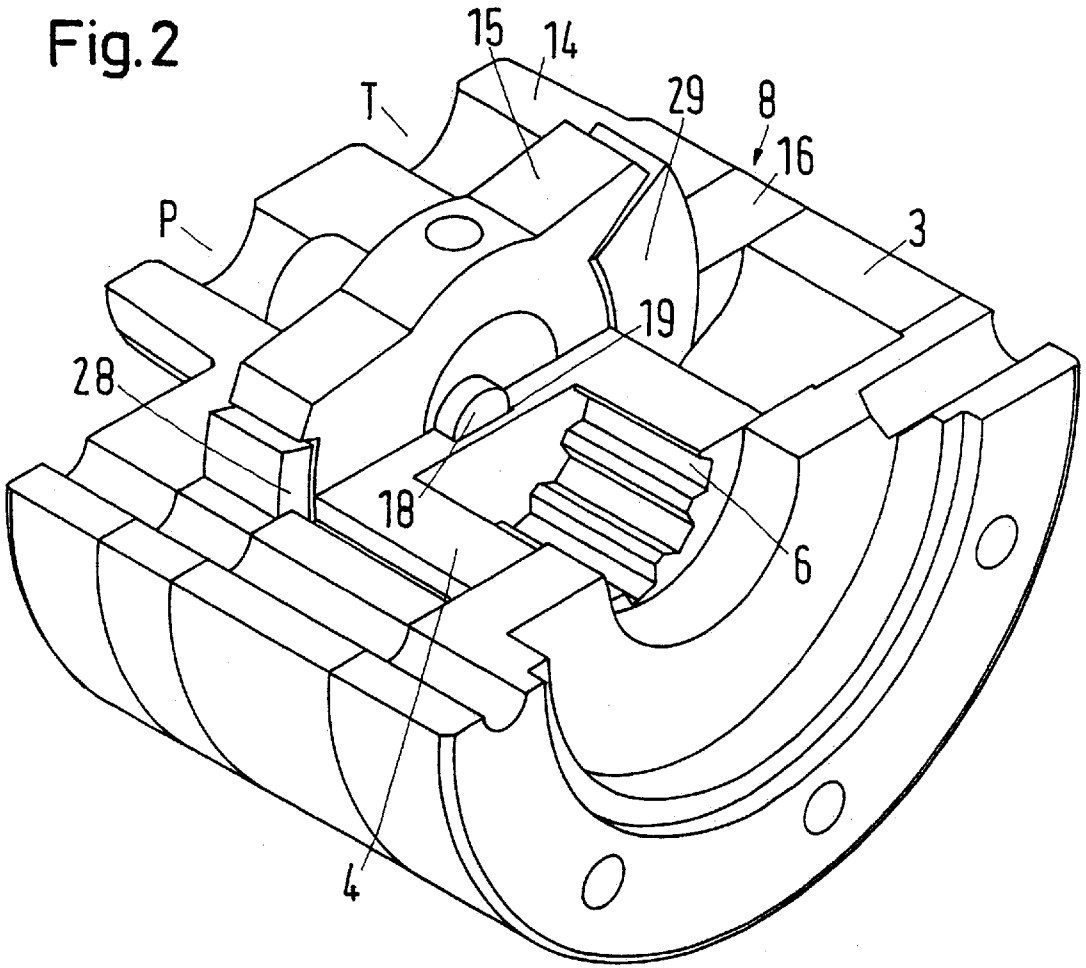
FIG. 2 shows the motor according to FIG. 1 with cut-away toothed gearing and a partially cut-away valve arrangement.
Figure 3:
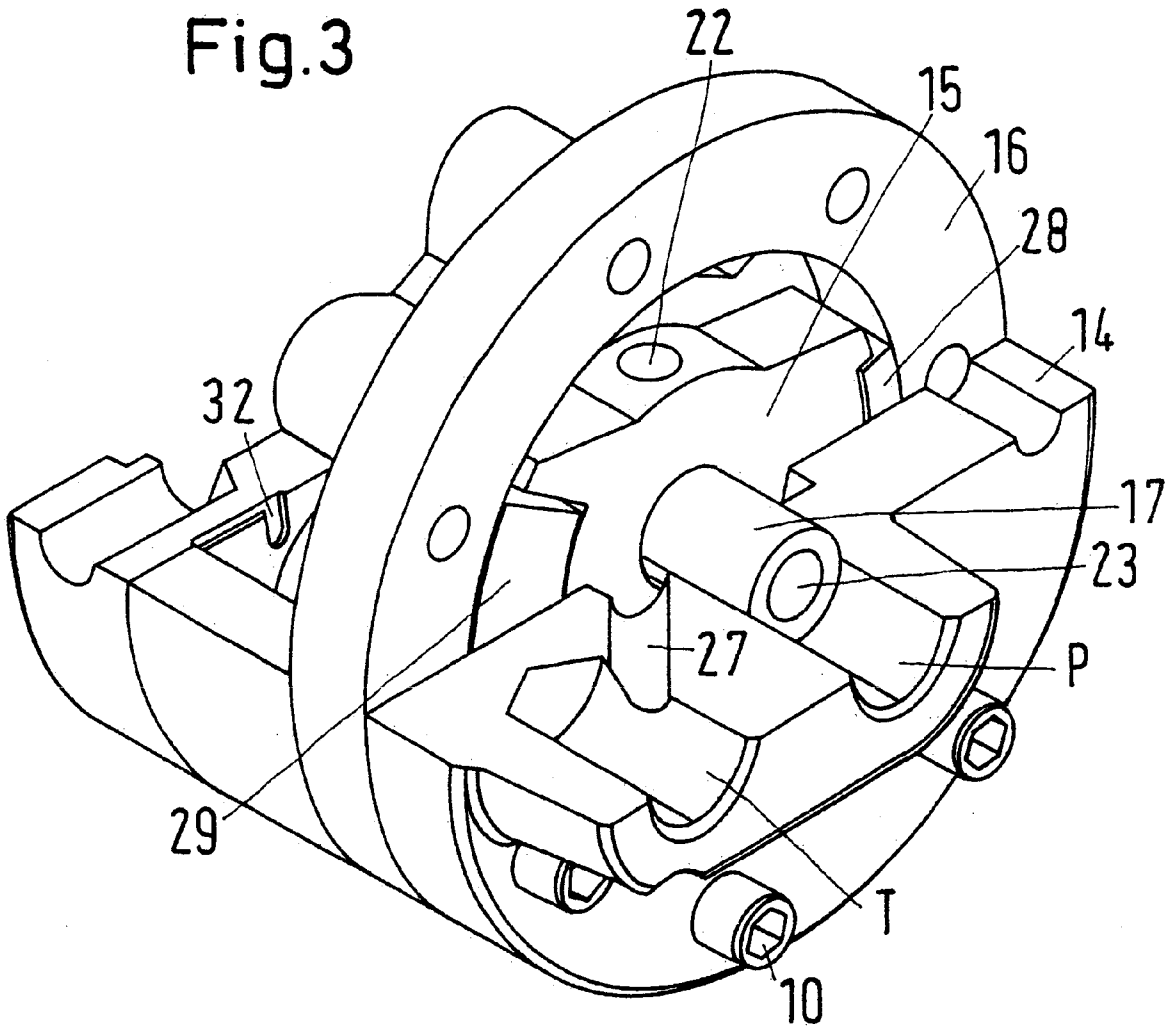
FIG. 3 shows the motor according to FIG. 2 from a different viewing angle, showing the valve arrangement in its entirety.
Figure 4:
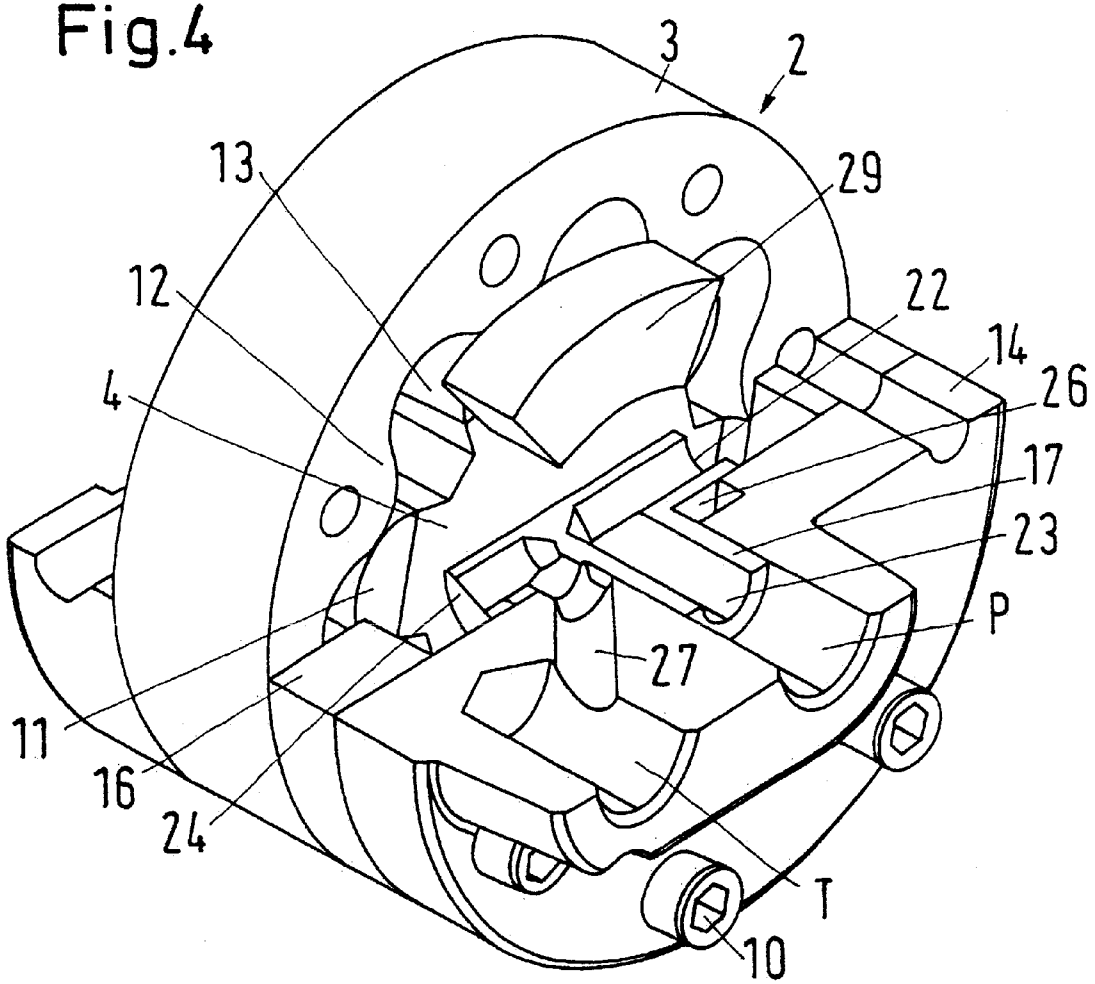
FIG. 4 shows the motor according to FIG. 3 with the toothed gearing in its entirety.

FIG. 1 shows a hydraulic motor 1, having toothed gearing 2 formed by an inner-toothed toothed ring 3 and an outer-toothed toothed wheel 4, which orbits and rotates inside the toothed ring 3. Wheel 4 is mounted eccentrically within ring 3. The toothed wheel 4 is connected to a Cardan shaft 5, which is inserted into corresponding toothing 6 (FIG. 2). The Cardan shaft 5 transmits the rotational movement of the toothed wheel 4 to an output shaft 7. A valve arrangement 8 (FIG. 1) is provided on the side of the toothed gearing 2 opposite the Cardan shaft 5. The toothed gearing 2, a housing 9 accommodating the shaft 7 and the valve arrangement 8 are held together axially by bolts 10 (FIGS. 3 and 4).

The toothed wheel 4 has one outer tooth 11 fewer than the toothed ring 3 has inner teeth 12. The outer diameter of the toothed wheel 4, that is to say the distance between opposite tooth tips, is exactly the same as the distance of a tooth tip of the toothed ring 3 from the deepest point of the opposite gap between teeth. The toothed ring 3 and the toothed wheel 4 thus co-operate in such a manner that they come into contact with one another at a number of points and form pressure pockets 13, as can be seen, for example, in FIG. 5. Since the toothed wheel 4 is mounted eccentrically in the toothed ring 3, the toothed wheel 4 moves inside the toothed ring 3 with a combined motion composed of a rotational movement and an orbital movement. The toothed wheel 4 orbits substantially more rapidly, however, than it rotates. The orbital speed is higher than the rotational speed by a factor n, where n corresponds to the number of outer teeth 11 of the toothed wheel 4. The number of pressure pockets 13 corresponds also to the number of outer teeth 11 of the toothed wheel 4.

Provided on the side of the valve arrangement 8 remote from the toothed gearing 2 is a housing cover 14, which has a high-pressure connection P and a low-pressure connection T. During operation of the motor, the valve arrangement 8 has to ensure that the pressure from the high-pressure connection P reaches the pressure pockets 13 that are increasing in size, whilst simultaneously the pressure pockets that are decreasing in size must be connected to the low-pressure connection T.

Figure 5:
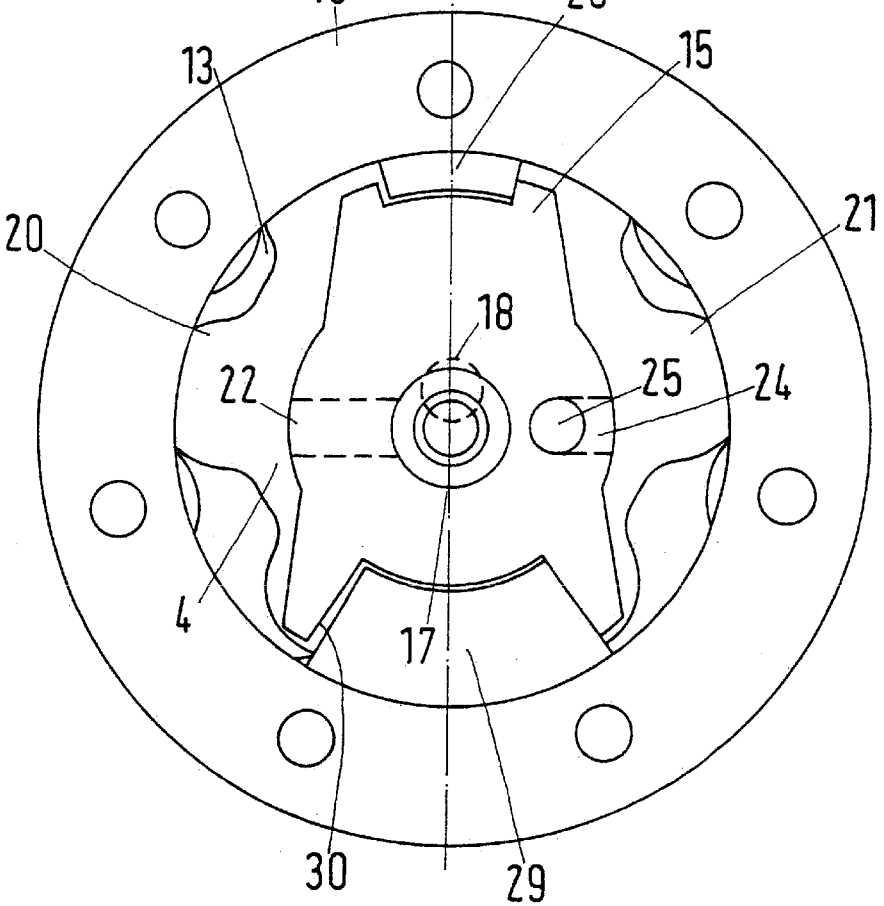
FIG. 5 is a diagrammatic view onto the end face of the valve arrangement.

For that purpose, the valve arrangement 8 has a rotary slide valve 15 arranged inside a valve plate 16. The rotary slide valve 15 has a bearing pin 17, by means of which it is mounted rotatably in the housing cover 14. As can be seen especially from FIG. 2, the rotary slide valve 15 rests against the toothed wheel 4. The rotary slide valve 15 is integral with a pin 18 that is arranged eccentrically relative to the bearing pin 17, (FIG. 2), the pin 18 being inserted in a central bore 19 in the toothed wheel 4. The outer diameter of the pin 18 and the inner diameter of the bore 19 are matched with one another so that although the pin 18 is arranged to be free of play in the bore 19 it can rotate therein. The radial distance between the pin 18 and the bearing pin 17 defines a lever, by means of which the toothed wheel 4 can exert torque on the rotary slide valve 15, so that the rotary slide valve 15 rotates in the valve housing 16 when the toothed wheel 4 orbits inside the toothed ring 3, which is connected to the valve plate 16 so as not to rotate therein. The rotary slide valve 15 divides the interior of the valve housing 16 into two halves, one on each side of a plane of symmetry S, into a high-pressure side 20 and a low-pressure side 21 (FIG. 5). The plane of symmetry S rotates relative to the valve housing 16 and hence relative to the toothed ring 3 at the orbital speed of the toothed wheel 4 so that the pressure pockets 13 which are increasing in size are supplied with hydraulic fluid under pressure, whilst pressure pockets 13 that are decreasing in size can convey the fluid away to the low-pressure connection T. (FIG. 2)

For that purpose, two channels are provided in the rotary slide valve 15, namely firstly a channel 22 which is connected to a channel 23 in the bearing pin 17, (FIG. 5), which channel 23 (FIG. 3) is in turn connected to the pressure connection P, (FIG. 2) and a channel 24 which is connected by way of an end-face bore 25 to an annular chamber 26 (FIG. 4) in the housing cover 14. A branch channel 27, which emerges from the low-pressure connection T, opens into that annular chamber 26. (FIG. 4).

Provided at the rotary slide valve 15 between the high-pressure side 20 and the low-pressure side 21 (FIG. 5) are sealing strips 28, 29, (FIG. 3) which extend over the entire axial length of the rotary slide valve 15. Those sealing strips 28, 29 rest radially inwards against the valve housing 16. As shown in exaggeratedly large form, the sealing strips are mounted with play 30 (FIG. 5) relative to the rotary slide valve 15 so that hydraulic fluid can penetrate from the high-pressure side 20 underneath the sealing strips 28, 29, in order to press the sealing strips against the inside of the valve plate 16 with increased pressure.

On the side remote from the valve arrangement 8, the teeth of the toothed wheel 4 have equalizing regions 31 (FIG. 1), which cooperate with corresponding openings 32 (FIG. 3) on the side of the housing 9 facing the toothed gearing 2. Hydraulic fluid under pressure, which is supplied to the pressure connection P, passes through the channels 23, 22 to the high-pressure side 20 and from there directly into the pressure pockets 13, can flow from pockets 13 through the openings 32 into the equalizing regions 31. Equalization is thus effected only where there is high pressure on the opposite side of the toothed wheel 4, namely on the high-pressure side 20. Hydraulic forces are thus equalized, which prevents the toothed wheel 4 from rubbing against the housing 9 with excessive friction.

The machine operates as a motor as follows: hydraulic fluid, which is supplied to the pressure connection P, passes through the channels 23, 22 to the high-pressure side 20 and from there directly into the pressure pockets 13 which are open as seen in FIG. 5. The hydraulic fluid brings about an increase in the volume of the pressure pockets 13 on the high-pressure side 20, which causes the toothed wheel 4 to rotate in a counter-clockwise direction, (FIG. 5). At the same time, the toothed wheel 4 orbits in the clockwise direction, so that a corresponding clockwise rotation of the rotary slide valve 15, (FIG. 5) is brought about as a result of the co-operation of pins 18 with bearing pins 17. This results in a corresponding rotation of the plane of symmetry S (FIG. 5) so that it is always the correct pressure pockets 13 that are supplied with hydraulic fluid under pressure, whilst the remaining bearing pockets can be emptied to the low-pressure connection T.

An additional seal between the rotary slide valve 15 and the toothed wheel 4 is accordingly not necessary. The pressure regions are so arranged that the correct pressure is always at the correct position so that additional sealing is not necessary.

Figure 6:
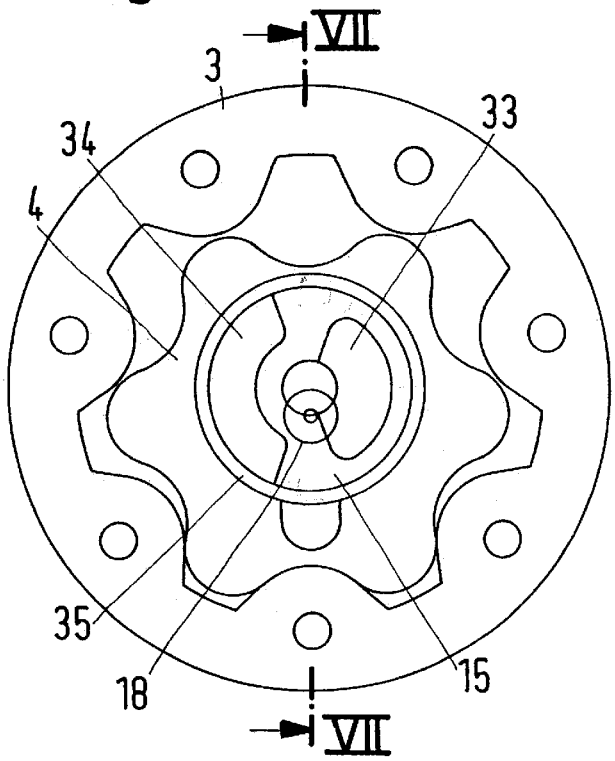
FIG. 6 is a plan view of an alternative construction of the valve arrangement.
Figure 7:
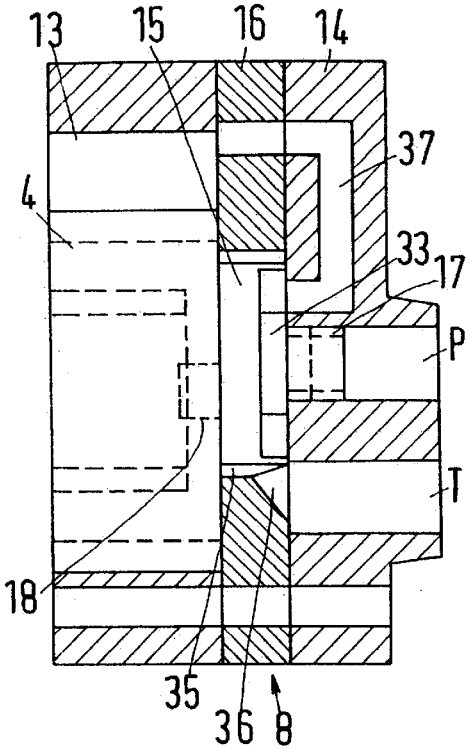
FIG. 7 is a section VII—VII according to FIG. 6.
Figure 8:
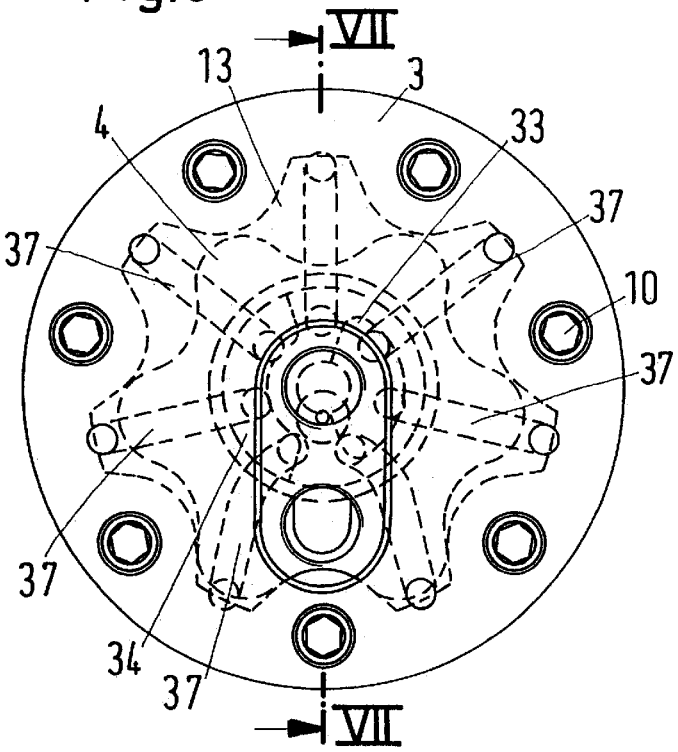
FIG. 8 is an end-face view of FIG. 7.

FIGS. 6 to 8 show a modified embodiment. Identical parts are provided with identical reference numerals.

In that embodiment, the rotary slide valve 15 is substantially smaller than the toothed wheel 4. As can be seen from FIG. 7, the rotary slide valve 15 still rests against the toothed wheel 4. The rotary slide valve 15 has on its sides remote from the toothed wheel 4 a high-pressure "kidney" 33, that is to say a kidney-shaped recess in the end face remote from the toothed wheel 4, which end face is covered by the housing cover 14. The connection to the high-pressure kidney 33 is effected by the bearing pin 17.

For the low-pressure side there is provided a low-pressure kidney 34, (FIG. 8), that is to say a corresponding opening on the end face of the rotary slide valve 15, which opening is covered by the housing cover 14. The low-pressure kidney 34 is connected to an annular channel 35 (FIG. 6) formed between the valve plate 16 and the rotary slide valve 15. The annular channel 35 is connected to the low-pressure connection T by way of an oblique bore 36. (FIG. 7).

As can be seen from FIG. 7, the individual pressure pockets 13 are connected to the high-pressure and low-pressure kidneys 33, 34 by channels 37, the channels 37 being arranged in the housing cover 14, and the fluid circulating around the outside of the rotary slide valve 15. The arrangement of the channels 37 is indicated in FIG. 8 by broken lines. From that Figure it can be seen that each channel 37 opens into the deepest point of a pressure pocket 13. Of the seven channels 37, three are connected to the low-pressure kidney 35 and three channels are connected to the high-pressure kidney 33, and one channel 37 is not connected to either of the two kidneys. Since the two kidneys 33, 34 rotate, together with the rotary slide valve 15, relative to the toothed ring 3 at the orbital speed of the toothed wheel 4, the individual pressure pockets 13 are always correctly supplied.

As a result of the fact that in both embodiments the rotary slide valve 15 is driven directly by the toothed wheel 4 and the drive can be constructed to be virtually without play, high-precision commutation can be achieved. It is virtually independent of loads that occur.

I claim:

1. A hydraulic motor, comprising, a housing means, an inner toothed ring within the housing, an outer toothed wheel eccentrically rotatably and orbitally mounted within the inner toothed ring and having upon being energized a rotational speed and an orbital speed within the inner toothed ring, with pressure pocket spaces appearing between the teeth of the ring and wheel, a hydraulic valve plate having an open center adjacent the wheel, a rotary slide valve mounted within the hydraulic valve plate, wherein the rotary slide valve and the toothed wheel are connected to one another directly by way of a drive connection, wherein the drive connection is formed by a drive pin that engages the wheel centrally and a bearing pin that supports the rotary slide valve eccentrically, which drive pin is mounted to rotate relative to the wheel and the bearing pin is mounted centrally in the valve housing, and wherein the bearing pin is formed integrally with the rotary slide valve, means for providing fluid under pressure into a first group of pressure pocket spaces, while fluid flows outwardly of the housing means through a second group of pressure pocket spaces to cause the wheel to rotate in a first direction, and an output shaft operatively connected to the wheel.

2. The motor according to claim 1 wherein the rotary slide valve rotates in a direction opposite to the direction of rotation of the wheel.

3. The motor according to claim 1, wherein the rotary slide valve divides the interior of the hydraulic valve plate into a high-pressure side and a low-pressure side.

4. The motor according to claim 3, wherein a sealing strip located at the rotary slide valve between the high-pressure side and the low-pressure side, which sealing strip rests radially inwards against the valve plate.

5. The motor according to claim 4, wherein a sealing strip is mounted with play relative to the rotary slide valve.

6. A motor according to claim 4, wherein the rotary slide valve has on an end face remote from the toothed wheel a high-pressure kidney-shaped recess and a low-pressure kidney-shaped recess, upon rotation, come into registration with openings of channels, the channels radially extending towards the outside of the rotary slide valve to an end face of the wheel.

7. A motor according to claim 4, wherein the rotary slide valve has a first fluid channel which opens on one side of the rotary slide valve and passes through the bearing pin, and a second fluid channel which opens on the other side of the rotary slide valve alternatively into an annular chamber surrounding the pin.

8. A motor according to claim 7, wherein the bearing pin is mounted rotatably in a housing cover.

9. A hydraulic motor, comprising, a housing means, an inner toothed ring within the housing, an outer toothed wheel eccentrically rotatably and orbitally mounted within the inner toothed ring and having upon being energized a rotational speed and an orbital speed within the inner toothed ring, with pressure pocket spaces appearing between the teeth of the ring and wheel, a hydraulic valve plate having an open center adjacent the wheel, a rotary slide valve rotatably mounted within the hydraulic valve plate, means for providing fluid under pressure into a first group of pressure pocket spaces, while fluid flows outwardly of the housing means through a second group of pressure pocket spaces to cause the wheel to rotate in a first direction, an output shaft operatively connected to the wheel, and wherein the rotary slide valve has a first fluid channel which opens on one side of the rotary slide valve and passes through a bearing pin, and a second fluid channel which opens on the other side of the rotary slide valve alternatively into an annular chamber surrounding the pin.

* * * * *